United States Patent [19]

Howe

[11] Patent Number: 4,753,006

[45] Date of Patent: Jun. 28, 1988

[54] DISPOSABLE RAZOR WITH SHAVING CREAM IN HANDLE

[76] Inventor: James E. Howe, P.O. Box 4818, New River Stage, Phoenix, Ariz. 85029

[21] Appl. No.: 841,883

[22] Filed: Mar. 20, 1986

Related U.S. Application Data

[63] Continuation-in-part of Ser. No. 707,397, Mar. 1, 1985, abandoned.

[51] Int. Cl.[4] ..... B26B 19/38

[52] U.S. Cl. ..... 30/41; 30/86; 222/96; 222/105

[58] Field of Search ..... 30/41, 86, 90; 222/94, 222/98, 101, 102, 125, 135, 96; 401/190

[56] References Cited

U.S. PATENT DOCUMENTS

| | | | |
|---|---|---|---|
| 2,392,975 | 1/1946 | Cooney | 30/41 |
| 3,221,940 | 12/1965 | Watson | 222/96 |
| 4,562,643 | 1/1986 | Cataudella | 30/41 |
| 4,635,361 | 1/1987 | De Mars | 30/41 |

*Primary Examiner*—Douglas D. Watts
*Attorney, Agent, or Firm*—H. Gordon Shields

[57] ABSTRACT

A disposable razor includes a handle having a compartment for containing a limited amount of shaving cream/gel, with the amount of the shaving cream/gel predetermined to be quantitatively the appropriate amount usable during the relatively short life of the disposable razor. The handle includes provisions for inserting and removing a container for the cream or gel in one embodiment and other embodiments disclose different elements for dispensing the cream or gel from the container through the bottom of the handle.

12 Claims, 2 Drawing Sheets

FIG. 1
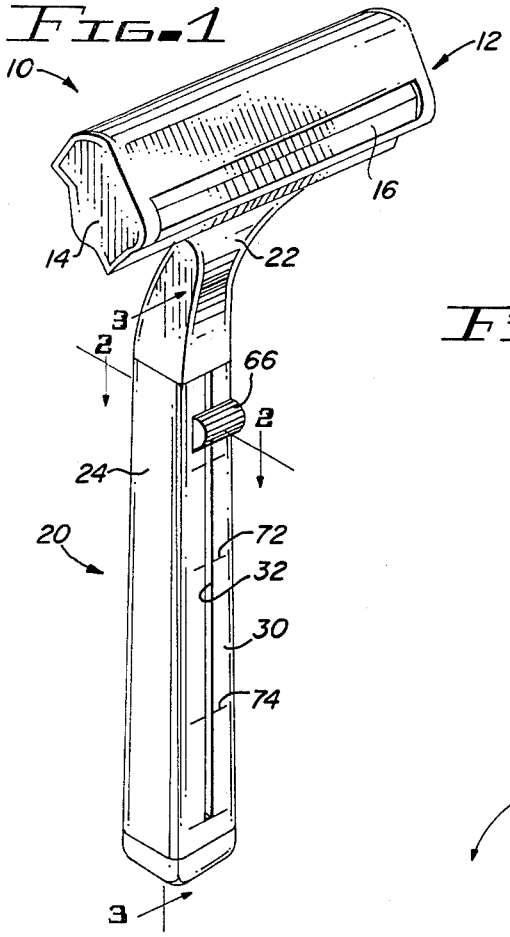
FIG. 2
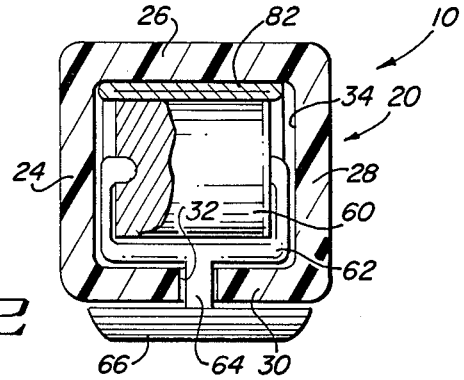
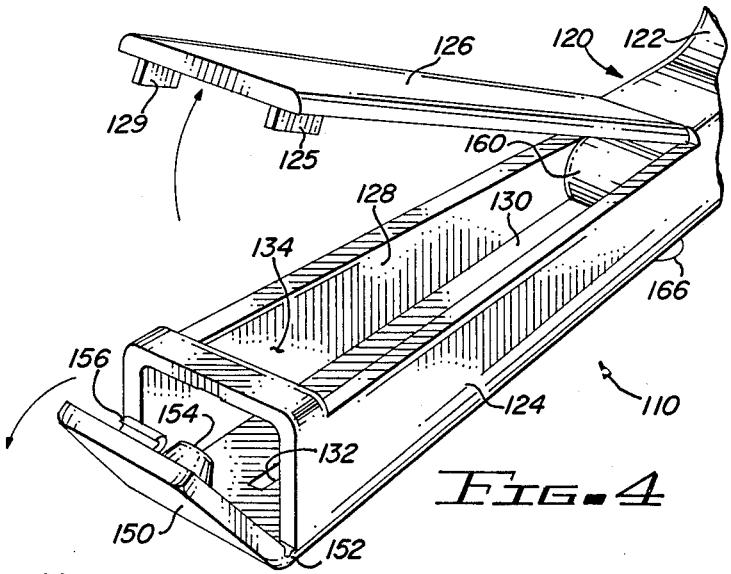
FIG. 4
FIG. 3
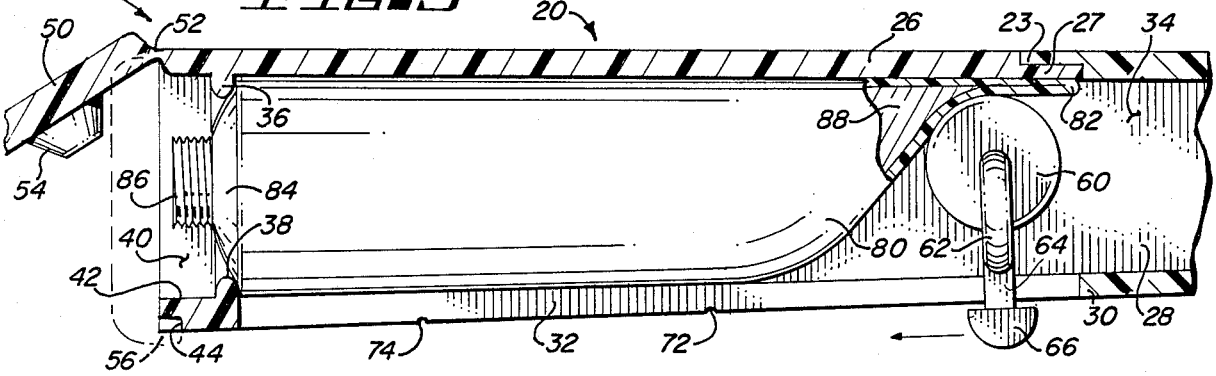
FIG. 5
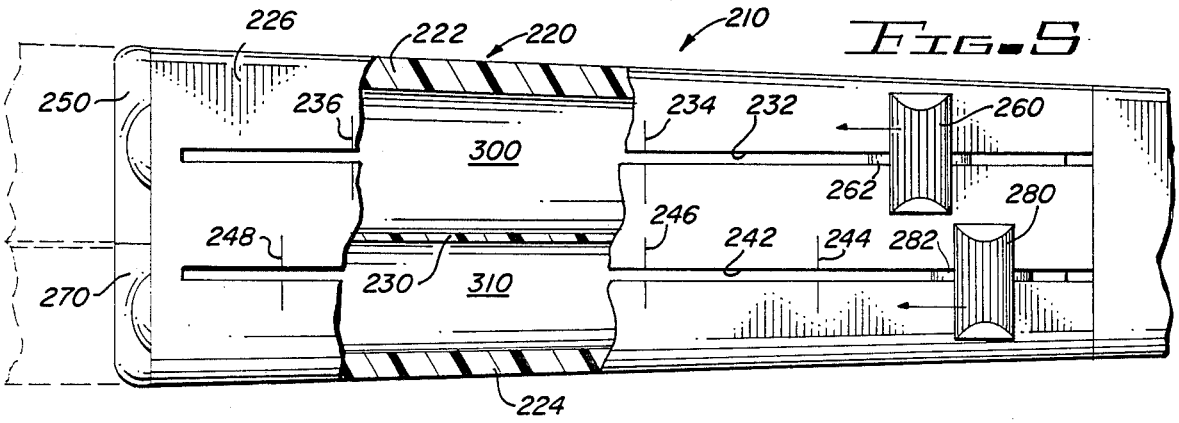

402
400
404
406
410
422
456
454
416
418
452
450
412
420
414
428
430
424
434
426
432
428
418
412
420
500
514
512
414
418
416
504
420
518
423
516
414
512
504
506
502
418
514
440
434
500
416
432
428
418
436
2
423
518
426
438
432
504
430
500
420
514
518
423
438
426
506
516
504
414
432
434
502
416
502
518
423
430
420
440
12
424
2
500
506
514
516
438
426
504
520
512
436
434
502
12

DISPOSABLE RAZOR WITH SHAVING CREAM IN HANDLE

CROSS-REFERENCE TO RELATED APPLICATION

This application is a continuation-in-part application of copending application Ser. No. 707,397, filed Mar. 1, 1985, now abandoned.

BACKGROUND OF THE INVENTION b 1. Field of the Invention:

This invention relates to razors and, more particularly, to disposable razors having a handle with a compartment therein for containing shaving cream/gel compositions.

2. Description of the Prior Art:

U.S. Pat. No. 2,679,951 disclosed a toothpaste dispenser in which a tube of toothpaste is disposed. The dispenser includes a roller which is moved by a handle and the roller moves longitudinally with respect to the tube of toothpaste to squeeze toothpaste out of the tube.

U.S. Pat. No. 3,221,940 discloses a toothpaste dispensing apparatus which includes a housing for a tube of toothpaste and a pair of rollers within a subassembly housing. The rollers are disposed on opposite sides of the toothpaste tube, and, as the subassembly housing is moved axially with respect to the toothpaste tube, the rollers squeeze toothpaste out of the tube. The apparatus includes a spring-loaded door which acts as a cap for the tube of toothpaste.

U.S. Pat. No. 3,412,465 discloses a safety razor with a compartment in the handle, and extending outwardly from the handle, for containing shaving cream or the like. The shaving cream is dispensed through a tube extending upwardly through the handle of the razor and terminating adjacent to the shaving head of the razor. The shaving cream is dispensed by applying pressure to the wall of the container that extends outwardly from the handle. The container for the shaving cream includes a flexible wall which extends outwardly from the handle and which is adapted to be squeezed so that the shaving cream flows out of the nozzle or tube.

An alternate embodiment in the '465 patent discloses a similar type of container for the shaving cream, but secured to the handle completely externally of the handle. Again, the container includes a tube which terminates adjacent to the head of the razor.

For a two-edged safety razor, there may be two shaving cream containers secured to the handle, the tubes or nozzles of which both terminate adjacent to the razor edges so that the shaving cream may be applied directly to the face of the user as the razor is brought to the face for shaving.

U.S. Pat. No. 4,077,119 discloses another type of razor in which a pressurized container is disposed in the handle for containing shaving cream. The shaving cream is dispensed from the pressurized container through a nozzle arrangement at the head of the razor. The dispenser is controlled by a button, and depressing the button dispenses the shaving cream through the head of the razor onto the surface being shaved.

U.S. Pat. No. 4,129,942 discloses a razor having a handle hollowed out and holding different items. The hollow handle may include more than one portion, each portion of which includes a separate chamber for holding different shaving associated material or grooming material. Shaving cream, aftershave lotion, pre-shave lotion, deodorant, etc., may be disposed within the chambers of the handle.

U.S. Pat. No. 4,377,034 discloses another type of safety razor in which a pressurized container of shaving cream is disposed within the handle of the razor. In this case, the pressurized container defines the handle of the razor, and the shaving head of the razor is secured to the upper portion of the container. The shaving cream is dispensed by a push-button arrangement. The nozzle through which the shaving cream flows is disposed adjacent to the razor head. However, the shaving cream is not dispensed through the razor head as in the '119 patent. Rather, the shaving cream is dispensed close to the shaving head, similar to the showing in the '465 patent.

In the razor systems disclosed in the '465, '119, and '034 patents, the shaving cream/gel is dispensed adjacent to the surface being shaved. Thus, in the first place, the razor must be positioned against or adjacent to the surface being shaved before the shaving compound is applied. In most cases, it is preferable to have the shaving compound remain on the area being shaved for a short period of time in order to allow the shaving compound to perform the desired function of softening the whiskers to be shaved. In utilizing the apparatus disclosed in the three patents, this either requires two separate operations, such as apply and wait, or else the shaving compound is applied to the area being shaved immediately before shaving. If two separate operations are utilized, then the handiness of having the shaving compound built into the handle of the container loses its effect by the awkwardness of applying the shaving compound either through or adjacent to the head of the razor. In addition, even though safety razors are disclosed, inadvertent movements of the razor may result in cutting or nicking the surface being shaved while applying the shaving compound.

In the '942 patent, the razor handle is taken apart to use the desired material contained in the handle.

The apparatus of the present invention overcomes the problems of the prior art by allowing the user to apply a shaving compound prior to the shaving operation, but retains the convenience of having the shaving compound stored in the handle of the razor. In addition, while the shaving compound is being applied, the razor blade or shaving head remains safely away from the area to be shaved, thus substantially eliminating the inadvertent cutting or nicking of the skin.

SUMMARY OF THE INVENTION

The invention described and claimed herein comprises a safety razor having a compartment in the handle of the razor for containing a shaving compound. The shaving compound may be removed from the compartment and applied to the surface to be shaved as desired.

Among the objects of the present invention are the following:

To provide new and useful disposable razor apparatus having an internal compartment for a shaving compound;

To provide new and useful razor apparatus having a shaving compound in the handle of the apparatus;

To provide new and useful disposable razor apparatus;

To provide new and useful razor apparatus having a compartment in the handle for containing a shaving compound;

To provide new and useful razor apparatus having a cylinder in the handle for shaving cream/gel and a piston movable in the cylinder for dispensing the cream/gel.

To provide new and useful disposable razor apparatus having a shaving compound in the handle of the razor removable from the apparatus and remote from the shaving head of the apparatus; and To provide new and useful disposable razor apparatus containing a quantity of shaving compound correlated with the expected shaving life of the shaving head.

BRIEF DESCRIPTION OF THE DRAWING

FIG. 1 is a perspective view of the apparatus of the present invention.

FIG. 2 is a view in partial section taken generally along line 2—2 of FIG. 1.

FIG. 3 is a view in partial section taken generally along line 3—3 of FIG. 1.

FIG. 4 is a perspective view of a portion of an alternate embodiment of the apparatus of the present invention.

FIG. 5 is a front view of a portion of an alternate embodiment of the apparatus of the present invention.

DESCRIPTION OF THE PREFERRED EMBODIMENT

Figures 6, 7, 8, 9, 10, 11, 12:
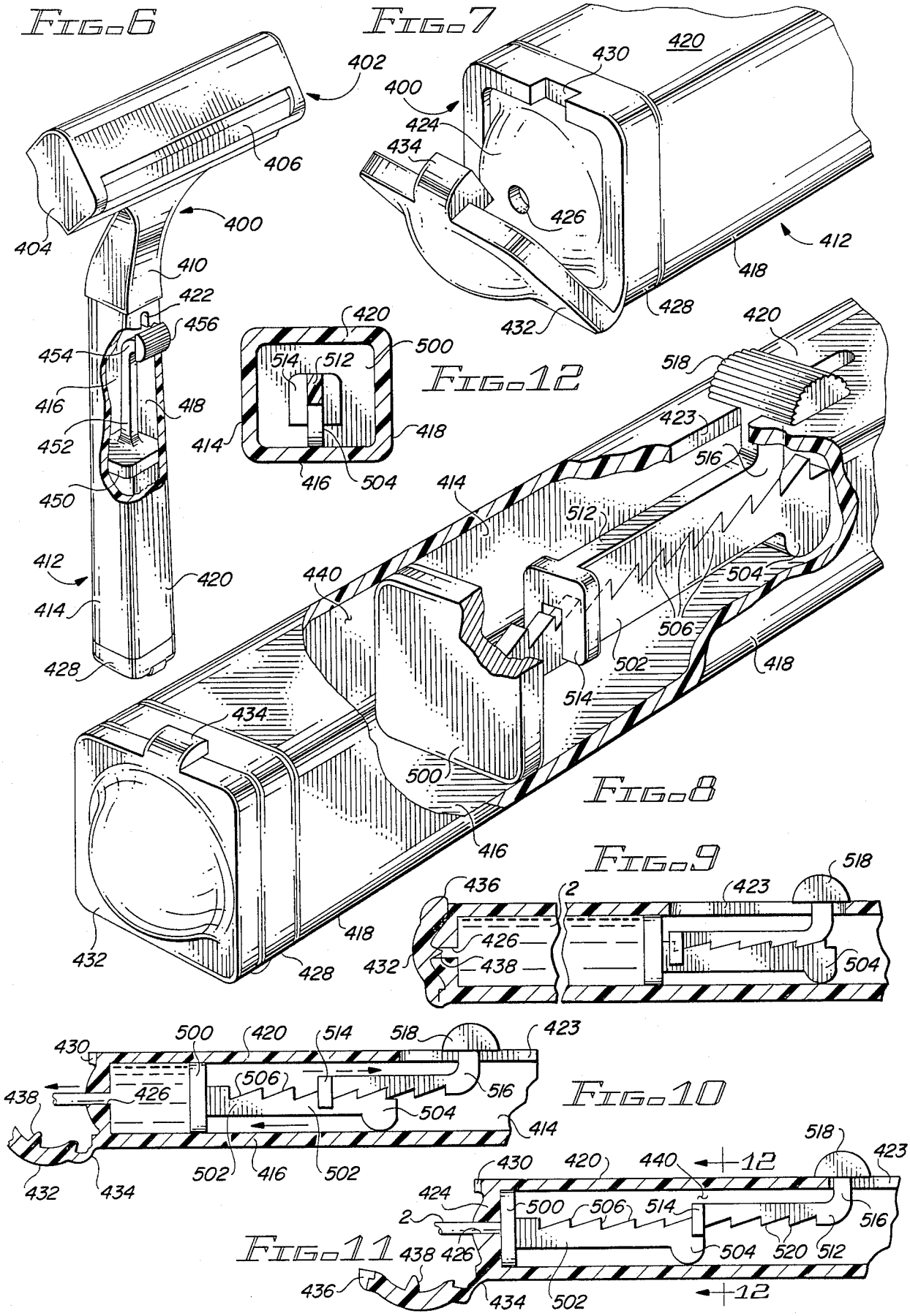
FIG. 6 is a perspective view of an alternate embodiment of the apparatus of the present invention.
FIG. 7 is a perspective view of a portion of the apparatus of FIG. 6.
FIG. 8 is a perspective view of another alternate embodiment of the apparatus of the present invention with a portion broken away.
FIG. 9 is a side view in partial section of a portion of the apparatus of FIG. 8.
FIG. 10 is a side view in partial section of the apparatus of FIG. 9, illustrating the functioning thereof.
FIG. 11 is a side view in partial section illustrating sequentially the actuation of the apparatus of FIGS. 9 and 10.
FIG. 12 is a view in partial section taken generally along line 12—12 of FIG. 11.

FIG. 1 is a perspective view of shaving apparatus 10 embodying the present invention. The shaving apparatus 10 includes a shaving head 12 and a handle 20. The head 12 generally includes a housing 14 and a blade 16. The blade is disposed in the housing 14 and is held therein. The outer edge of the blade 16 is disposed on the outside of the housing 14 for purposes of shaving.

Since the particular design of the head 12 is not involved in the apparatus of the present invention, no further discussion will be directed thereto.

The handle 20 includes an upper neck portion 22 which secures the handle 20 to the head 12. The apparatus of the present invention is directed primarily to the handle 20.

FIG. 2 is a view in partial section taken generally through the handle 20 of the razor apparatus 10. FIG. 2 is taken generally along line 2—2 of FIG. 1.

FIG. 3 is a view in partial section of a portion of the handle 20 of the shaving apparatus 10. FIG. 3 is taken generally along line 3—3 of FIG. 1.

For the following discussion concerning the shaving apparatus 10, reference will primarily be made to FIGS. 1, 2, and 3.

The handle 20, below the neck 22, generally includes four panels, including panels 24, 26, 28, and 30. The four panels 24 . . . 30 enclose or define an inner cavity or chamber 34. Panels 24 and 28 are side panels, panel 26 is a back or rear panel, which is removable, and a panel 30 is a front panel. The front panel 30 includes a vertically extending slot 32. The slot 32 extends for substantially the entire length of the panel 30.

Near the bottom of the chamber 34 is an inwardly extending lip 36. The lip 36 defines a throat or aperture 38. Beneath the lip 36 is a lower or bottom chamber 40. The bottom chamber 40 is closed by a cap 50. The lip 36 extends inwardly on the surface of all four panels, including the removable back panel 26. This provides a relatively continuous shoulder between the chamber 34 and the chamber 40.

An opening 42 is defined at the bottom of the chamber 40, remote from the rib or shoulder 36 and its opening or aperture 38.

The cap 50 is secured to the removable back panel 26 by an integral or living hinge 52. Extending outwardly from the inner surface of the cap 50 is a conical plug 54. The cap opens and closes the opening 42 of the chamber 40. In FIG. 3, the cap 50 is shown in its open position, and is shown in its closed position in dotted line or phantom outline.

A snap 56, shown in phantom in FIG. 3, is used to secure the cap 50 to the side of the handle 20 when the cap 50 is closed. The front panel 30 includes a recess 44 which receives the snap 56 to secure the cap 50 to the panel 30.

The removable back panel 26 includes a front tab 27 which is disposed beneath a mating tab 23 on the lower portion of the neck 22. This is shown in FIG. 3. The mating tabs 23 and 27 and the snap 56 disposed in the recess 44 secures the back panel 26 to the other three panels of the handle 20.

As best shown in FIG. 3, a tube 80 containing shaving cream or gel 88, or the like, is disposed within the chamber or cavity 34. The tube 80 includes a rear or bottom end 82 which tapers upwardly or forwardly to a front shoulder 84. The front shoulder 84 is shown disposed on the inner peripheral ridge or lip 36 at the bottom of the handle 20 and extends through the opening 38. A nozzle 86 for the tube 80 extends from the front shoulder 84 and into the lower chamber 40. The nozzle 86 includes an appropriate aperture through which the contents 88, gel or cream, etc., is dispensed from the tube 80 through the opening 42 when the cap 50 is "open" and the nozzle 86 is uncovered.

When the cap 50 is closed on the housing 20, the conical plug 54 extends into the nozzle 86 and defines or comprises a closure element for the tube 80 to prevent the inadvertent release of the cream or gel with the tube 80.

For dispensing the cream or gel from the tube 80, a roller 60 is used. The roller 60 is disposed in the upper end of the handle 20, adjacent to the neck 22. The roller includes a yoke 62 which extends forwardly from the roller 60. The yoke 62 is in turn secured to an arm 64. The arm 64 extends outwardly through the slot 32 in the front wall panel 30. A lever 66 is disposed on the distal end of the arm 64, remote from the yoke 62. The lever 60 is appropriately configured to receive a thumb or finger of a user of the apparatus 10, as convenient, for moving the roller downwardly against the tube 80.

As best shown in FIG. 3, and as may also be understood from FIG. 2, the diameter of the roller 80 is a substantial fraction of the width of the handle 80 between the rear panel 26 and the front panel 30. More-over, the width of the roller 80 is substantially the same as the width of the chamber 34 between the side walls 24 and 28. A downward movement of the roller 80, as by applying pressure on the lever 66, as indicated by the large arrow in FIG. 3, causes the roller 60 to bear against one side of the tube 80. The walls of the tube 80 are virtually pushed together by the roller 60. This provides a force sufficient to cause the gel or foam or whatever to flow out of the tube 80 through the nozzle 86 and into the waiting hand of a user of the apparatus 10. The user then applies the cream or gel, etc., to soften whiskers, etc., preparatory to shaving.

On the front panel 30 of the handle 20, and adjacent to the slot 32, there are two marks 72 and 74. The two marks 72 and 74 are approximation marks or indicia for dividing the contents of the tube into thirds. That is, when the lever 66 is moved downwardly to the mark 72, the user of the apparatus 10 knows that about one third of the contents 88 of the tube 80 has been used. When the lever 66 is moved downwardly to the mark 74, the user of the apparatus 10 knows that about two-thirds of the contents of the tube has been used. Obviously, if desired, the indicia markings could be in fourths, or in any other convenient scale.

The apparatus 10 of the present invention is designed primarily for travel use of the like. The blade 16 should last at least three days, and perhaps more. Similarly, the cream or gel 88 within the tube 80 should be of a sufficient quantity for two or three shaves, commensurate with the number of shaves expected from the blade 16. Thus, a convenient marking system, such as the marks 72 and 74, is employed.

For inserting a tube 80 into the handle 20, the back panel 26 is removed by lifting up on the cap 50 and pivoting the panel 26 upwardly to disengage the interlocked tabs 23 and 27. The cap 50 is first unlocked or unsnapped by pulling the tab 56 from the drecess 44. The lip 27 of the panel 26 is then removed from beneath the mating lip 23 to free the panel 26 from the handle 20. The tube or container 80 is then inserted into the chamber 34 of the handle, with the bottom end 82 disposed "on top" of the roller 60, and the shoulder 84 disposed against the inwardly extending flange or ridge 36. It will be noted that the nozzle 86 is typically externally threaded to receive a cap (not shown). For convenience, the tube or container cap is removed after the tube or container 80 is disposed within the handle 20. Then, when the lid or cap 50 is in place, the conical stop or plug element 54 is disposed into the nozzle 86, thus sealing the tube 80.

After the tube 80 is disposed within the handle 20, the back panel 26 is placed on the handle, as discussed above. It will be noted, as illustrated in FIG. 3, that with the back panel 26 in place on the handle 20, the container 80 is disposed against the panel 26. The container 80 is biased on is pressed against the panel 26 by the roller 60 as the roller 60 is moved downwardly by a user pressing on the lever 66 in order to dispense the desired quantity of cream or gel 88 from the tube or container 80. The pressure of the roller forces the contents 88 to flow out of the nozzle 86 and into the hand of the user.

If desired, the tube 80 may be removed from the handle and the user may dispense cream or gel directly into the user's hand from the tube instead of using the roller 60 and the lever 66 to dispense the cream or gel from the handle 20.

Also, if desired, the blade 16 may be replaceable. This would provide a travel unit of more than a mere throw-away or disposable nature.

FIG. 4 is a perspective view of an alternate embodiment 110 of the razor apparatus 10 of FIGS. 1-3. The razor apparatus 110 includes the same general elements, with a handle 120 secured to a neck 122, and the neck 122 in turn extends to and is secured to a shaving head (not shown).

The handle 120 includes four basic panels, including a pair of side panels 124 and 128 and a front panel 130 and a back panel 126. The back panel 126 is hinged by a "living" hinge to the upper portion of the handle 120, adjacent to the neck 122. The back panel is thus not completely removable from the handle 120, but rather it pivots upwardly and away from the handle 120 on its living hinge.

At the bottom of the handle 120 is a cap 150 which is also secured to the handle 120 by a living hing 152. The cap 150 includes a conical plug or stopper element 154 which is used to seal the nozzle of a tube (not shown in FIG. 4), disposed within the handle, in a manner similar to the sealing relationship between the tube 80, its nozzle 86, and the plug 54 of the cap 50.

The handle includes an inner chamber or cavity 134 in which is disposed a tube of shaving cream or gel or the like. The tube is oriented in the chamber in a manner similar to the tube 80 shown in handle 20 in FIG. 3. The interior of the handle 120 may include an inwardly extending ridge, etc. (not shown) to hold the tube in the handle, as shown in the embodiment of FIG. 3.

A roller 160 and a lever 166 may be used to dispense the contents of the tube from the handle 120. The front panel 130 includes a slot 132 in which is disposed the necessary mechanical or structural elements for moving the roller 160 by means of the lever 166.

The hinged back panel 126 includes a pair of tabs 125 and 129 which extend outwardly from the panel 126 and they are adapted to be disposed against the sides 124 and 128, respectively. The tabs 125 and 129 are locking tabs which secure the panel 126 against the panels 124 and 128 of the handle 120.

Indicia for indicating the approximate quantity of material remaining in the tubes or containers may also be included on the front of the panel 130, as discussed for the panel 30 and the indicia marks 72 and 74.

FIG. 5 comprises another alternate embodiment 210 of the apparatus of the present invention. The apparatus 210 may be similar to the apparatus 10 or 110, except that it includes provisions for two tubes or containers within its handle 220.

The handle 220 includes a pair of side walls 222 and 224, and a longitudinally extending flange 230 which divides the interior of the handle 220 into two chambers or compartments 300 and 310. It will be noted that the compartments 300 and 310 are not of equal size, with the compartment 300 being larger than the chamber 310. A container may be disposed within the chamber or compartment 300 between the wall 222 and the flange 230, and another, smaller container may be disposed between the wall 224 and the flange 230.

The handle 220 includes a top panel or wall 226. There are a pair of axially extending slots 232 and 242 which extend through the panel or wall 126. The slots 232 and 234 communicate respectively with the two chambers 300 and 310 within the handle 120.

At the bottom of the handle 220 is a pair of caps 250 and 270. The caps 250 and 270 are fastened to the handle 20 through "living" hinges. The caps provide access to the compartments 300 and 310 within the handle 120, and they close the chambers, as with caps 50 and 150, discussed above in conjunction with the apparatus 10 and 110. Accordingly, they are opened when it is desired to dispense material from the tubes within the handle, as with the caps 50 and 150.

For dispensing the contents of the tubes, a pair of levers 260 and 280 are provided. The levers 260 and 280 are respectively secured to a pair of rollers 262 and 282. The rollers 262 and 282 are in turn disposed against the containers or tubes within the chambers 300 and 310.

For approximating the contents of the container within the chamber 300, marks 234 and 136 are shown extending outwardly on either side of the slot 232. For approximating the contents of the tube or container within the chamber 310, marks 244, 246, and 248 are shown. As with the other quantity indicating indicia of the apparatus 10 and 110, the indicia or marks may conveniently be molded into the material out of which the apparatus are made.

Operation of the levers 260 and 280 and their rollers, with respect to the tubes or containers within the chambers 300 and 310, is substantially the same as discussed above in conjunction with the rollers 60 and 160 and the containers or tubes 80 and 180 of the apparatus 10 and 110. A downward movement on the levers 260 and 280 will cause the rollers 262 and 282 to apply pressure against the containers, which in turn causes the contents of the containers to be dispensed.

It will be noted that the handle 220 is somewhat wider than the handles 20 and 120 so as to enable two tubes to be disposed within the handle. The larger of the tubes or containers within the chamber 300 preferably includes a shaving gel or cream, while the container within the chamber 310, which is substantially smaller than the chamber 300, may contain an aftershave lotion, a cologne, etc. Obviously, the relative sizes of the chambers 300 and 310, and the contents of their containers, are obviously matters of choice. Also, a substantially greater quantity of shaving cream or gel will be used with each shave than a cologne or aftershave, etc.

The loading or inserting of the tubes into the chambers 300 and 310 of the handle 220 may be accomplished in substantially the same manner as discussed above for the handles 20 and 120. The back of the handle 220 may include one or two removable or pivotable panels or walls, similar to the panel 26 or to the panel 126. When the wall or walls is/are removed, the tubes or containers may be inserted, and the back panel or panels may then be resecured to the handle. The apparatus is then ready for use.

The caps 250 and 270 may also include conical plugs for sealing the tubes in the chambers 300 and 310, as desired, and as discussed above for the other embodiments.

FIG. 6 is a perspective view of razor apparatus 400, comprising an alternate embodiment of the apparatus of the present invention. The razor apparatus 400 includes a head 402 and a handle 412. The head 402 and the handle 412 are connected by a neck 410. The head 402 includes a housing 404 with a blade 406 secured to the housing 404.

FIG. 7 is a perspective view of part of the handle 412, namely the lower part. For the following discussion, attention will be directed primarily to FIGS. 6 and 7.

The handle 412 is shown as generally square tubing. It is obvious that the handle 412 may be circular, as well as square. The square tubular handle 412 includes a side 414, a back 416, a second side 418, and a front 420. The sides 414, 418, and the back 416 and the front 420 are panels connected together as an integral tubular member enclosing or defining a hollow interior. A piston 450 is movably disposed within the hollow interior.

The front 420 includes a slot 422 extending axially for a substantial distance. The slot 422 cooperates with piston elements which will be discussed below.

A bottom end wall 424 closes the lower portion of the handle, and a chamber or cylinder 440 is defined within the handle between the wall 424 and the piston 450. An aperture 426 extends through the bottom end wall. Shaving cream or gel disposed within the chamber or cylinder 440 is dispensed through the aperture 426 in the end wall 424.

For convenience, a rim 428 is disposed at the lower end of the handle 412 and about the very low or bottom portions of the four panels 414, 416, 418, and 420 which comprise the square tubular handle 412. The rim 428 includes a locking slot 430.

An end cap 432 is connected to the rim 428 at the back side 416 of the handle 412 by an integral, or living, hinge 434. See FIGS. 10 and 11. Such arrangement is well known and understood in the art. Obviously, the end cap 432 may be a separate element, and a pin type hinge, also well known in the art, may be used. The end cap 432 includes a tab 434 which extends into the locking slot 430 to secure the end cap 432 to the end wall 424 and thus to cover the aperture 426 to prevent the inadvertent release of shaving cream or gel disposed with the chamber 440.

The piston 450 is remote from the end wall 424 to allow for the maximum amount, or the desired amount, of shaving cream or gel to be loaded into the chamber 440 of the handle 412. Extending outwardly from the piston 450, and in the direction away from the end wall 424, is a piston rod 452. At the outer end of the piston rod, remote from the piston 450, is an actuator arm 454. The actuator arm 454 extends through the slot 422. An actuator tab 456 is in turn secured to the actuator arm 454 on the outside of, and adjacent to, the front panel 420 of the handle 412.

The piston 450 is moved longitudinally or axially with respect to the handle 412 by a force, typically a user's thumb, disposed on or against the actuator tab 456. As the actuator 456, and thus the piston 450, is moved axially in the slot 422, and with the end cap 432 open, as shown in FIG. 7, (and as also shown in FIGS. 10 and 11), shaving cream or gel disposed within the chamber 440 exudes outwardly through the aperture 426 in the end wall 424.

The overall length of the slot 422 is as long as the length or height of the chamber 440 to allow all of the gel or cream disposed within the chamber 440 to be used. Obviously, it follows that the length of the rod 452 is the same as the length of the chamber 440. When the chamber 440 is at its maximum size, with the piston 450 at its most distal point from the bottom end wall 424, the piston 450 is disposed adjacent to the lower end of the slot 422. With the piston 450 disposed adjacent to the inside of the end wall 424, thus minimizing the height or length of the chamber 440, as when the gel or cream has been substantially used up, the actuator arm 454 will be at the lower end of the slot 422.

While the use of the piston 450 is simplified with respect to the apparatus 400, it will be understood that the overall efficiency of the apparatus is relatively low since the handle 412 must be configured in overall length according to the amount of cream or gel desired to be loaded into the chamber 440 of the handle 412. The overall length of the handle must accordingly be twice the desired length of the chamber 440 in order to accommodate the piston rod 452 with its actuator arm 454 and the actuator tab 456. For many applications, such an arrangement may be satisfactory. An alternate embodiment of the piston 450 and its rod 452 is shown in FIGS. 8, 9, 10, 11, and 12, and will be discussed below.

It will be noted that the configuration of the handle 412 is generally square for the entire length of the handle. It will also be noted that, if desired, the size of the handle 412 may be reduced upwardly from the chamber or cylinder 440. Obviously, the handle portion adjacent to, or defining, the chamber 440, must be of a uniform size to accommodate the piston 450. However, remote from that area, the size of the handle is relatively immaterial, and thus may be necked down, if desired. The same thing is true if the handle configuration is circular or round instead of square. That is, a round handle may also be necked down remote from the chamber which contains the cream or gel. Since the diameter or size of the actuator rod is relatively small compared with the size of the piston, it follows that the size of the handle in which the actuator rod is disposed may vary, as desired.

FIG. 8 is a perspective view of a portion of the handle 412, partially broken away, disclosing an alternate embodiment of the piston 450 and its rod 452. The rest of the structure of the handle remains fundamentally the same as shown in FIGS. 6 and 7. FIGS. 9, 10, 11, and 12 are views in partial section illustrating the structure and operation of the apparatus of the alternate embodiment.

For decreasing the overall length of the handle 412, or for increasing the overall length of the chamber 440, a two-piece piston rod may be used. A two-piece piston rod is shown in FIGS. 9, 10, 11, and 12. The handle 412 may remain substantially the same in the embodiment of FIGS. 8, 9, 10, 11, and 12, with the only essential difference being in the length of a slot 423 which extends through the top or front panel 420.

In FIG. 8, a piston 500, which is essentially the same as the piston 450, is shown secured to a piston rod 502. The piston rod 502 includes a guide tab 504 remote from the piston 500. The guide tab 504 extends downwardly from the piston rod 502 and is disposed on, or rests on, the inside surface of the bottom wall 416. The purpose of the guide tab 504 is simply to maintain the piston rod 502 at a constant height or level within the handle 412 as the piston 500 and the piston rod 502 are moved within the handle. The top or upper surface of the piston rod 502 is characterized by a plurality of ratchet teeth 506. The ratchet teeth 506 are designed for one-way movement of the piston rod 502 so that the piston 500 moves toward the end wall 424.

Disposed on top of the rod 502 and its ratchet teeth 506 is an actuator rod 512. The actuator rod 512 includes a yoke 514 at one end.

The yoke 514 comprises an inverted "U" extending downwardly substantially perpendicular to the length of the rod 512. The inverted "U" includes a pair of arms which extend downwardly on opposite sides of the piston rod 502. See FIG. 12. The distance or width between the arms of the yoke 514 is substantially the width of the piston rod 502. The yoke 514 comprises, essentially, a guide element to insure that the actuator rod 512 and the piston rod 502 remain together so that the actuator rod 512 does not come loose from the rod 502.

The actuator rod 512 includes an upwardly extending arm 516. The arm 516 extends through the slot 423 in the top or upper panel 420. The width of the slot 423 is slightly greater than the width of the arm 516. An actuator tab 518 is in turn secured to the arm 516 above, and adjacent to, the upper surface of the top or front panel 420.

Extending downwardly, on the bottom surface of the actuator rod 512, is a plurality of downwardly extending ratchet teeth 520. The ratchet teeth 520 are complementary to the ratchet teeth 506 of the piston rod 502. The ratchet teeth 520 mesh or mate with the ratchet teeth 506 to move the piston 500 toward the end wall 524. In turn, the movement causes the cream or gel disposed within the chamber 440 to flow outwardly through the aperture 426 in the end wall 424.

As the actuator tab 518 is moved axially in the slot 423 towards the end wall 424, the meshing of the complementary teeth 506 and 520 of the piston rod 502 and the actuator rod 512, respectively, causes the piston 500 to move axially and cream flows outwardly through the aperture 426. In FIG. 9, the cap 432 is shown covering the end wall 424 and the aperture 426. Movement of the piston rod 500 is prevented, and cream or gel 2, disposed within the chamber 440, does not flow through the aperture 426. However, as illustrated in FIG. 10, with the end cap 432 removed, the piston rod 502 is allowed to move and the piston 450 causes the cream or gel 2 to flow. Movement is accomplished through the cooperative meshing of the complementary teeth 506 and 520 when a force is applied to the actuator tab 518 to move the actuator rod 512, through the arm 516, axially in the slot 423. As illustrated in FIG. 10, cream or gel 2 flows outwardly through the aperture 426. The movement of the tab 518 and the related elements is shown in FIG. 10 by the solid arrow.

Since the ratchet teeth have a one-way locking action, moving the actuator rod 512 rearwardly or away from the end wall 424, as indicated by the dotted line arrow in FIG. 10, causes the actuator rod 512 to move rearwardly with respect to the piston rod 502. However, due to the yoke 514, the rods 502 and 512 remain in a juxtaposed relationship. Essentially, the ratchet teeth 506 and 520 simply slide over each other due to the complementary action of the sloping portions of the ratchet teeth, as is well known and understood.

It will be noted that, as best shown in FIGS. 9, 10, and 11, there is sufficient clearance or distance between the top of the actuator rod 512 and the bottom surface of the top panel 420 to allow the actuator rod 512 to move upwardly by a cam action with respect to the complementary teeth 506 and 520 so that the tips of the teeth 506 and 520 clear each other to allow the rod 512 to move rearwardly. However, due to the length of the arms of the yoke 514, the rods 502 and 512 remain in a juxtaposed or an adjacent relationship.

As shown in FIG. 11, the ratcheting relationship between the rods 502 and 512 may continue until the overall combined length of the two rods is the overall length of the chamber 440. Thus, substantially all of the material within the chamber 440 is forced out through the aperture 426. In FIG. 11, the piston 500 is shown disposed adjacent to the inner surface of the end wall 424, and accordingly the chamber 440 is emptied of its material.

It will be understood that the overall length of the slot 423 is minimized as compared with the overall length of the slot 422, discussed above in conjunction with FIGS. 6 and 7, the combined length of the rods 502 and 512 is the total or overall length of the chamber 440.

For convenience, the piston 500 is shown without a sealing element, such as an O-ring. Obviously, sealing elements are well known and understood and may be employed as desired or as required.

In FIGS. 9, 10, and 11, there is shown a conical element 438 extending outwardly from the inside of the cap 432. In FIG. 9, the conical element is shown extending into the aperture 426 to act as a plug or sealing element for the aperture. With the cap 432 open, as shown in FIGS. 10 and 11, the conical plug element 438 is withdrawn from the aperture 426.

The cap 432 is shown open in FIGS. 10 and 11, and generally aligned somewhat parallel to the length or longitudinal axis of the handle 412. If desired, for ease of access to the cream or gel 2 flowing out of the chamber 440 through the aperture 426, the cap 432 may be bent or pivoted downwardly and back (or up) alongside the handle.

Referring to FIG. 5, it will be obvious that the apparatus of FIGS. 6–12 may be made to include two chambers and two pistons, etc., if desirable. The two chambers may both include the same material for increasing the amount of material, or two different materials may be included.

Also, referring to FIGS. 1 and 6, it will be obvious that indicia may be added adjacent to the slot 422 to indicate the quantity of material in the chamber 440. Such indicia may not be practical with the embodiment of FIGS. 8–12 due to the double actuator rod system. However, if the handle apparatus were made of a relatively light colored plastic material, not necessarily transparent, but perhaps at least translucent, and if the piston 500 were of a relatively dark or bright color, then its location may be judged. In such case, quantitative indicia may be disposed on virtually any of the four panels, if desired.

The end wall 424 is shown with its exterior surface convexly curved. The interior surface of the cap 432 is concavely curved to provide a complementary surface for the exterior surface of the end wall. The curved or rounded exterior surface is advantageous for cleanliness purposes. It is easier to wipe off all of the extruded or exuded material from the aperture 426 when the exterior surface is rounded.

While the aperture 426 is shown centered in the end wall 424, there may be advantages in having the aperture off center. Preferably, the aperture may be located above the center point, or away (remote) from the hinge 434. Again, as with the curved exterior surface, the reason for the assymetrical disposition of the aperture is for cleanliness purposes, for ease of cleaning or removing the material.

It will be noted that there is a discrepancy in the number of ratchet teeth shown in FIG. 8, as compared to the number of ratchet teeth shown in FIGS. 9, 10, and 11. Obviously, any number of ratchet teeth may be used. For ease of illustration, the number of ratchet teeth shown in FIGS. 9, 10, and 11 has been limited.

While the principles of the invention have been made clear in illustrative embodiments, there will be immediately obvious to those skilled in the art many modifications of structure, arrangements, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Shaving apparatus, comprising, in combination:
a shaving head;
handle means secured to the shaving head, including
chamber means for receiving material to be dispensed, and
bottom means closing one end of the chamber means remote from the shaving head through which the material is dispensed, including
aperture means through which the material is dispensed, and
cap means secured to the handle means and pivotally movable between a closed position closing the aperture means and an open position for dispensing the material through the aperture means; and
piston means movable in the chamber means for dispensing the material through the aperture means, including
a piston movable in the chamber means against the material to be dispensed,
a rod connected to the piston, and
arm means connected to the rod and extending outwardly from the handle means, and movement of the arm means moves the piston.

2. The apparatus of claim 1 in which the arm means includes an arm connected to the rod and a tab connected to the arm, and movement of the tab causes movement of the arm, the rod, and the piston.

3. The apparatus of claim 2 in which the handle means further includes a slot and the arm extends through and is movable in the slot.

4. The apparatus of claim 3 in which the handle means further includes indicia disposed adjacent to the slot for quantitatively indicating the contents of the container.

5. The apparatus of claim 1 in which the chamber means includes a first chamber for receiving first material and a second chamber for receiving second material.

6. The apparatus of claim 5 in which the piston means includes first piston means for dispensing the contents of the first chamber, and second piston means for dispensing the contents of the second chamber.

7. The apparatus of claim 1 in which the bottom means includes an end wall, and the aperture means includes an aperture extending through the end wall.

8. The apparatus of claim 7 in which the cap means includes a plug element comprising a closure for the aperture when the cap means is in the closed position.

9. Shaving apparatus, comprising, in combination:
a shaving head;
handle means secured to the shaving head, including
chamber means for receiving material to be dispensed, and
bottom means closing one end of the chamber means remote from the shaving head, including
aperture means through which the material is dispensed, and cap means secured to the handle means and pivotally movable a closed position closing the aperture means and an open position for the dispensing of the material; and dispensing means movable in the chamber means for dispensing the material through the aperture means, including piston means piston rod means secured to the piston means, and actuator rod means cooperating with the piston rod means to move the piston means.

10. The apparatus of claim 9 in which the dispensing means further includes a tab secured to the piston rod for maintaining the piston rod at a constant height in the chamber means and cooperating ratchet teeth on the piston rod and the actuator rod for one-way movement of the piston for dispensing the material.

11. The apparatus of claim 9 in which the dispensing means includes a tube disposed in the chamber means, and the material to be dispensed is in the tube.

12. The apparatus of claim 11 in which the piston means of the dispensing means further includes a roller movable against the tube for dispensing the material.

* * * * *